US005456464A

United States Patent [19]

Davenport et al.

[11] Patent Number: 5,456,464

[45] Date of Patent: Oct. 10, 1995

[54] GOLF PUTTER

[76] Inventors: Joshua C. Davenport, 323 Washington Rd., Rye, N.H. 03870; Robert A. Patton, 61 Red Mill La., Rye Beach, N.H. 03871

[21] Appl. No.: 191,367

[22] Filed: Feb. 3, 1994

[51] Int. Cl.[6] ..... A63B 53/02; A63B 53/04

[52] U.S. Cl. ..... 273/80 C; 273/167 R; 273/169

[58] Field of Search ..... 273/167 R, 169, 273/80 C, 173

[56] References Cited

U.S. PATENT DOCUMENTS

| | | | |
|---|---|---|---|
| 807,224 | 12/1905 | Vaile | 273/80 C |
| 2,820,638 | 1/1958 | Morrison | 273/80 C X |
| 2,926,913 | 3/1960 | Stecher | 273/80 C |
| 3,194,564 | 7/1965 | Swan | 273/80 C X |
| 3,332,684 | 7/1967 | Solheim | 273/81.3 |
| 4,073,492 | 2/1978 | Taylor | 273/80.2 |
| 4,128,244 | 12/1978 | Duclos | 273/164 |
| 4,141,556 | 2/1979 | Paulin | 273/164 |
| 4,181,306 | 1/1980 | Jepson | 273/173 |
| 4,693,478 | 9/1987 | Long | 273/164 |
| 4,747,599 | 5/1988 | Antonious . | |

*Primary Examiner*—William H. Grieb
*Attorney, Agent, or Firm*—William B. Ritchie

[57] ABSTRACT

An improved putter exhibiting centrifugal balance. Centrifugal balance is defined as the ability of the putter to tend to swing in a straight line, even when deliberately forced to rotate. Centrifugal balance ensures that a golfer will be provided with a club having inherent stability along the intended line of the putt. Centrifugal balance is achieved by providing the putter shaft with a calculated curved section and predetermined angle of attachment such that the straight portion of the shaft is positioned so that a line extended along the axis of the straight portion intercepts on the front face of the head. An axis that is perpendicular to this extended line at the intercept will then pass through the center of gravity of the club. The center of gravity of the head is positioned well aft of the front face of the club and achieved by having a head shape that has two substantial theoretical centers of gravity in the sole and heel portions of the head. The club head is preferably jadeite of a specific density which provide sufficient mass as well as strength necessary to withstand the stresses of putting a ball. The combination provides a putter having a high degree of centrifugal stability with an exceptionally large "sweet spot".

11 Claims, 4 Drawing Sheets

| PT. | DIST. | D.D. |
|---|---|---|
| 0 | 1/2" | 1/8" |
| 1 | 1" | 3/16" |
| 2 | 1 1/2" | 1/4" |
| 3 | 2" | 3/8" |
| 4 | 2 1/2" | 9/16" |
| 5 | 3" | 3/4" |
| 6 | 3 1/2" | 15/16" |
| 7 | 4" | 1 1/8" |
| 8 | 4 1/2" | 1 5/16" |

GOLF PUTTER

BACKGROUND OF THE INVENTION

1. Field of the Invention

The invention relates to golf clubs, and, in particular, putters meeting USGA specifications.

2. Description of the Related Art

During a theoretical round of par golf, one half of the strokes recorded are taken on the greens with a putter. Since putting forms such an important part of the game, it is no surprise to find a wealth of attempts to improve the basic club. However, most of the designs, notwithstanding elaborate assertions regarding the efficacy, do not meet the specifications of United States Golfing Association and, therefore, are not permitted to be used in sanctioned play.

Added to the substantial variety of putter configurations is the superstition of the golfer. It is common to find golfers having several putters, changing from one to another, depending on the perceived "karma" of the moment. Yet, clearly, repetitive practice with the same putter, assuming that putter represents ideal considerations, is the best path to consistent accurate putting.

Very little has been done over the seasons to improve upon the concepts advanced by Karsten Solheim, U.S. Pat. No. 3,332,684, issued July, 1967. That patent discloses the idea of bending the shaft of the golf club near the grip so that the extended center line of the grip is caused to extend slightly in front of the leading edge of the club head a distance equal to the less than the diameter of a golf ball, but great enough that the extended center line passes in front of the leading edge of the club, and between the toe and heal thereof.

U.S. Pat. No. 4,747,599, issued on May 31, 1988, discloses a triangular hosel structure that is said to prevent the club head from turning when the club face is struck at a point that is not at the center of percussion. Various styles of club faces and heads are shown attached to the triangular hosel structure.

U.S. Pat. No. 4,073,492, issued of Feb. 14, 1978, discloses an adjustable head and shaft that must be locked into an irreversible position in order to meet USGA requirements.

U.S. Pat. No. 4,693,478, issued on Sep. 15, 1987, discloses an oversized head which is said to improve the resistance of the club to be rotated when the club face strikes the ball.

U.S. Pat. No. 4,141,556, issued on Feb. 27, 1979, discloses a putter having a triangular shaped head that is said to improve the stroking movement of the club as it strikes the ball.

U.S. Pat. No. 4,128,244, issued on Dec. 5, 1978, discloses an alignment device for golf clubs, including putters. A slot which is aligned with golfer's eyes and along the line which it is desired to hit the ball is provided. It is noted that this "sight" is not necessary for good golfers.

A putter that inherently has centrifugal balance will result in improved play for golfers of all levels of ability since this feature enhances the player's ability to roll the ball consistently along the intended line of the putt. A putter having this inherent characteristic is not found in the prior art.

SUMMARY OF THE INVENTION

It is an object of the invention to provide an improved golf putter that improves the golfer's consistency so that he/she will be less inclined to switch putters during the course of sequential rounds.

It is another object of the invention to provide an improved golf putter that meets USGA requirements.

A further object of the invention is to provide an improved golf putter that utilizes a material for construction of the head that is ideal for the stresses encountered when a golf ball is struck.

Another object of the invention is to provide an improved golf putter that has a head which is sufficiently hard to permit the transmission of "feel" as defined by knowledgeable golfers.

Still another object of the invention is to provide an improved golf putter that has a large "sweet spot" on the face of the head.

It is another object of the invention to provide an improved golf putter that inherently provides horizontal balance.

It is a final object of the invention to provide an improved golf putter that inherently provides centrifugal balance.

DETAILED DESCRIPTION OF THE INVENTION

Figure 1:
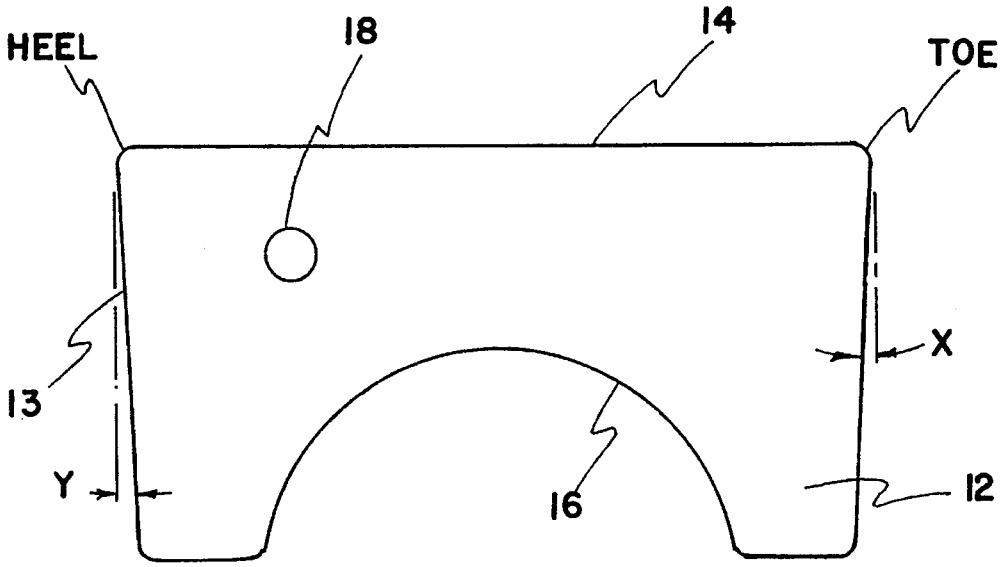
FIG. 1 is a top view of the putter head in accordance with the invention.

FIG. 1 is a top view of the putter head in accordance with the invention. The putter head shape, materials used in construction, attachment position of the shaft, specific progressive shaft bend, alignment of the shaft relative to the club face, and center of gravity have been optimally selected to meet the objectives defined above.

Putter head 12 is preferably made from jadeite. Jadeite has a tough, fibrous molecular structure that is most suitable for the stresses involved while putting a golf ball. The relative hardness of jadeite permits the transmission of the sought after quality known as "feel". In reality, "feel" is due to the harmonic vibration which is transmitted to the hands of the golfer through the head of the putter and the shaft. Also, the density of the jadeite contributes to other unique properties which are discussed below. However, any material which approximates the density of jadeite and possesses its molecular integrity will serve as well. The preferred jadeite should have a density of approximately 74 grams per cubic inch.

The concept of perimeter weighting requires the designer to distribute sufficient weight in the heal and toe areas of the club without sacrificing material rigidity in the hitting area. The total weight of the club head, in this case a putter head, must be kept within the confines of 310 to 325 grams to provide the golfer with a putter that performs well on all variety of grasses. FIG. 1 displays a progressive heel to toe weight distribution effected by the back radius consistent curvature. This design feature contributes to the centrifugal balance characteristic found in this putter.

Front face 14 is preferably 4⅛ inches long. Face 14 is milled flat on a diamond disc grinding mill. Further, front face 14, the symmetrical curvature of back face 16, the uniform back taper from the toe and the heel shown in FIG. 1 as the angle at x & y, present to the golfer a collage of proper visual alignment factors, tending to eliminate a target fixation on the golf ball and promoting accuracy in the resulting shot. These taper angles x and y are preferably 3°. Head 12 is preferably about 2¼ inches wide.

Attachment hole 18 is approximately 0.37 inches in diameter to accept standard shaft tips and is located 13/16 of inch from left side 13 and 25/64 of inch from front face 14. The position of the shaft relative to the putter head is critical in order to achieve the objectives provided herein.

Figure 2:
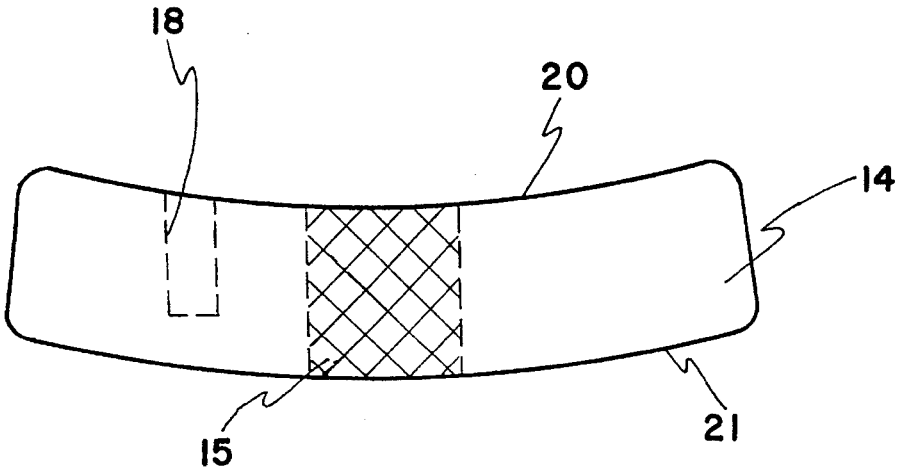
FIG. 2 is a front view of the putter head.

FIG. 2 is a front view of the putter head. Note that crown 20 and sole 21 have the same radius which is preferably 8⅞ inches to permit proper soling of the head on the ground. This radius has been selected as it enables various hand positions by the golfer and, thus, not disrupting the golfer's putting style. This radius also allows the putter to operate effectively though the accepted range of lie angles found in the USGA approved putter guidelines. The lie angle is the angle between the horizontal and the putter shaft when the putter is placed in the standard putting position. Sweet spot 15 (the crosshatched area on FIG. 2) shows where a golf ball can be hit with the club head and still be expected to roll true because no rotation is caused in head 12. Spot 15 is approximately ⅞ inches wide and covers the entire vertical face of the putter within that area.

Figure 3:
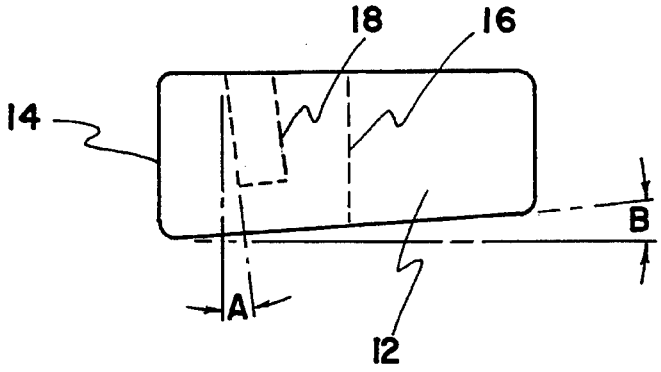
FIG. 3 is a side view of the putter head.

FIG. 3 is a side view of the putter head 12 shown set up for a right-handed golfer. For left-handed golfers, Attachment hole 18 would be on the other side of head 12. Head 12 is preferably about 1 inch thick. Attachment hole 18 is tilted at angle A which is set at 7 degrees. This angle is critical in that it accepts the bend on the shaft to set the lie angle, the alignment of the straight portion of the shaft to the putter head face, and contributes to the centrifugal balance concept. Angle A permits the completed putter to assume the proper lie angle. This also contributes, along with the placement of mass around the back radius 16 to the overall centrifugal balance (discussed below) of the putter.

Angle B is set so that putter head 12 has a 2 degree loft angle for the face. FIG. 3 shows the 4 degree cut back; 2 degrees of that is used to set the loft angle and 2 degrees is left for the sole taper from the face to the rear of the head. Loft angle is constant across the entire face of the putter. Loft angle is the angle between the vertical and the club face when the putter is held in the address position.

Figure 4:
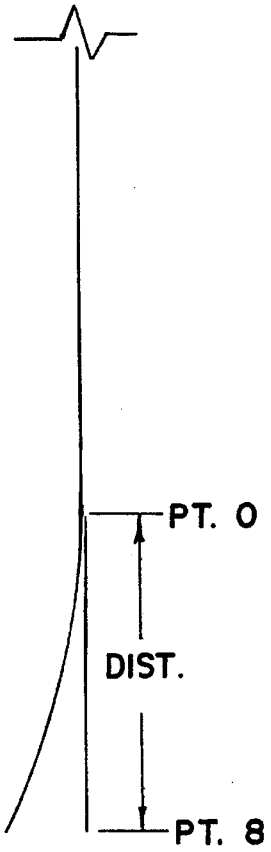
FIG. 4 illustrates the desired bend in the shaft of the putter relative to the centerline extension from the butt to the tip of the shaft.

FIG. 4 illustrates the desired bend in shaft 20 (shown in FIG. 5) of the putter relative to the centerline extension from the butt. The butt of the shaft is the end of the shaft under the grip or handle. The bend of the shaft is oriented so that the straight portion of the shaft lines up with the face of the putter. The specific curve is defined by the table. Point 0 is 4½ inches from the tip end of shaft 20. Note that approximately ⅝ inches of shaft 20 is inserted in head 12. A shaft 20 deflection curve is defined along one half inch increments measured from Point 0 to Point 8. Point 8 corresponds to the tip end of shaft 20.

The deflection curve is such that when the shaft tip is inserted in the hole and the putter is placed faced down on a table, the straight portion of the shaft, above the bend, will also lie flat on the table. The deflection curve is designed to accomplish several tasks. First, it sets the lie angle for the putter. Second, it allows for the transition to attachment hole 18. Third, it permits the alignment of the leading (edge closest to hole) edge of the shaft, at its straight section, with head front face 14. Fourth, it permits the straight section of shaft 20 to align with a force vector passing through the center of mass of head 12. Finally, it contributes to the centrifugal balance of the putter.

Figure 7:
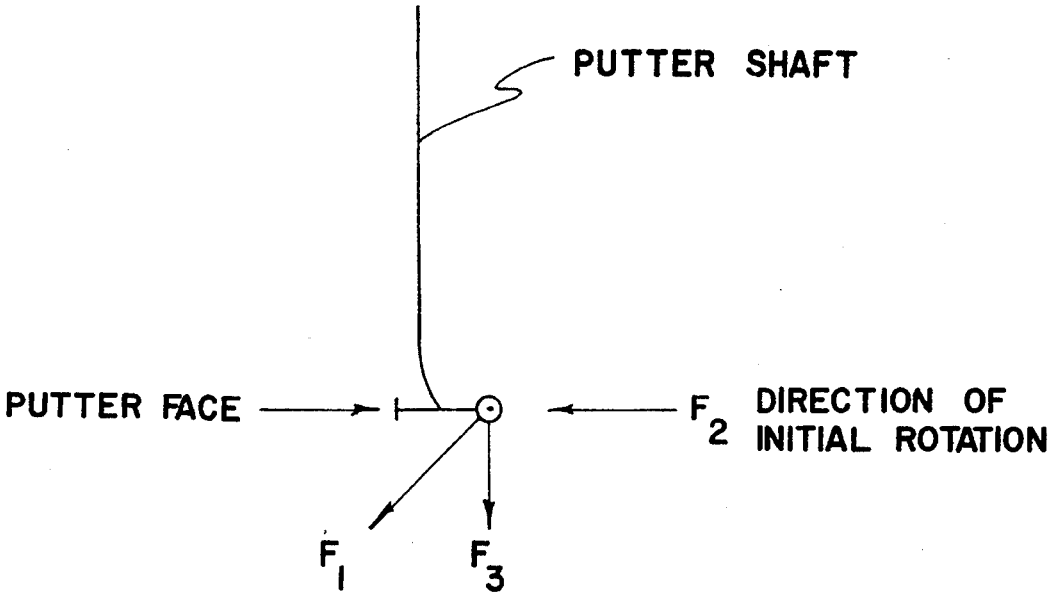
FIG. 7 is vector diagram showing the forces that provide the centrifugal balance of the club in accordance with the invention.

The force vectors of interest for the invention are shown in FIG. 7. Forces presented at angles can be graphically depicted by their horizontal and vertical components. These force vectors also come into play as reactions. For every action there is an equal and opposite reaction. For one to visualize a force of 100 ft/lbs acting on a point at a 45 degree angle, that same point would have experienced the same effects as if two forces acted upon it, one at 0 degrees and the other at 90 degrees. Both forces equaling 100 divided by the square root of 2 or 87.60 ft/lbs.

In the case of a putter head, the ideal reactive force vector is the one passing thru the center of mass of the head at the center of the "sweet spot". The larger the "sweet spot" the greater the margin for error in striking the ball and the less twisting in the head with the resulting opening or closing of the club fact causing deviations to the intended line of the putt.

Centrifugal balance is an unique property of this putter that is not found in prior art putters. Centrifugal balance is best demonstrated by holding the putter grip between the thumb and forefinger of the left hand. This type of test is routinely performed by golfers to test for a putter's "sweet spot" or center of mass. While testing accordingly, the golfer usually taps along the face of the putter with a joint of a bent finger of the right hand. The purpose of the test is to located the area in the central portion of the putter face where the head does not rotate when tapped. This is shown as spot 15 in FIG. 2. Spot 15 is approximately ⅞ inches long.

The unique property of centrifugal balance can be demonstrated by swinging the putter in a straight line, i.e., as a pendulum in a clock. If the putter is forced to rotate in a circular motion, after several circular rotations, the invention returns to that straight pendulum action again. The centrifugal balance of the putter provides a stability to any putting stroke that enhances control so that the golfer can more easily putt the ball on the intended line.

Figure 6:
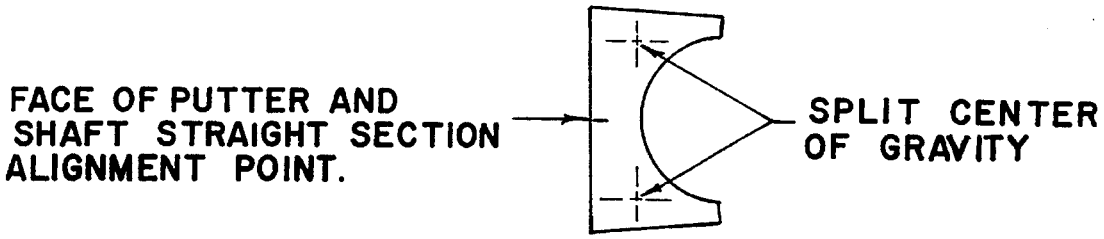
FIG. 6 is a diagram of the putter head showing the "split" center of gravity concept.

The unique feature of centrifugal balance of the invention provide the inventor's putter with an inherent stability along the intended line of the putt. This ability is effectuated by theoretically "splitting" the center of gravity of the putter head as shown in FIG. 6 and placing what is now the actual center of mass well aft of the putter face. Each crossed circle in FIG. 6 corresponds to a theoretical center of mass representing approximately one half the weight of the putter head.

The specified bend to the shaft, that confirms to USGA rules, aligns the upper straight portion of the shaft with the surface of the putter face at the point where a perpendicular to the face at this point passes thru the center of mass. Given the above configuration, the further aft from the putter face we place the split centers of gravity, the sooner will the putter recover from its imputed rotation to a straight pendulum action.

The ability to design this feature into the putter is limited by the acceptable total weight of putter heads as defined above, the density of the material used for the putter head and the desire to keep putter cosmetics acceptable to the golfer. Centrifugal balance is not limited to the preferable specified head shape specified but could be achieved with other shapes provided the principles disclosed herein are followed. As long as the putter head utilized has the shaft aligned with the putter face as specified and the center of gravity of the head is correspondingly split and moved aft as disclosed, the putter will exhibit centrifugal balance.

In FIG. 7, the component force $F_1$ represents the summation of forces $F_2$ and $F_3$ and provides the downward and forward force that causes the initial elliptical action. This elliptical action soon degenerates into a straight pendulum action. As the putter shaft connection located in the head approaches the location of the center line of the split centers of gravity the downward thrusting $F_1$ diminishes. This force is created as a function of the distance from the face to the center of gravity centerline multiplied by the weight of the head. In the preferred embodiment, 320 grams multiplied by 2.54 centimeters or a force of 812.8 centimeter/grams.

Figure 5:
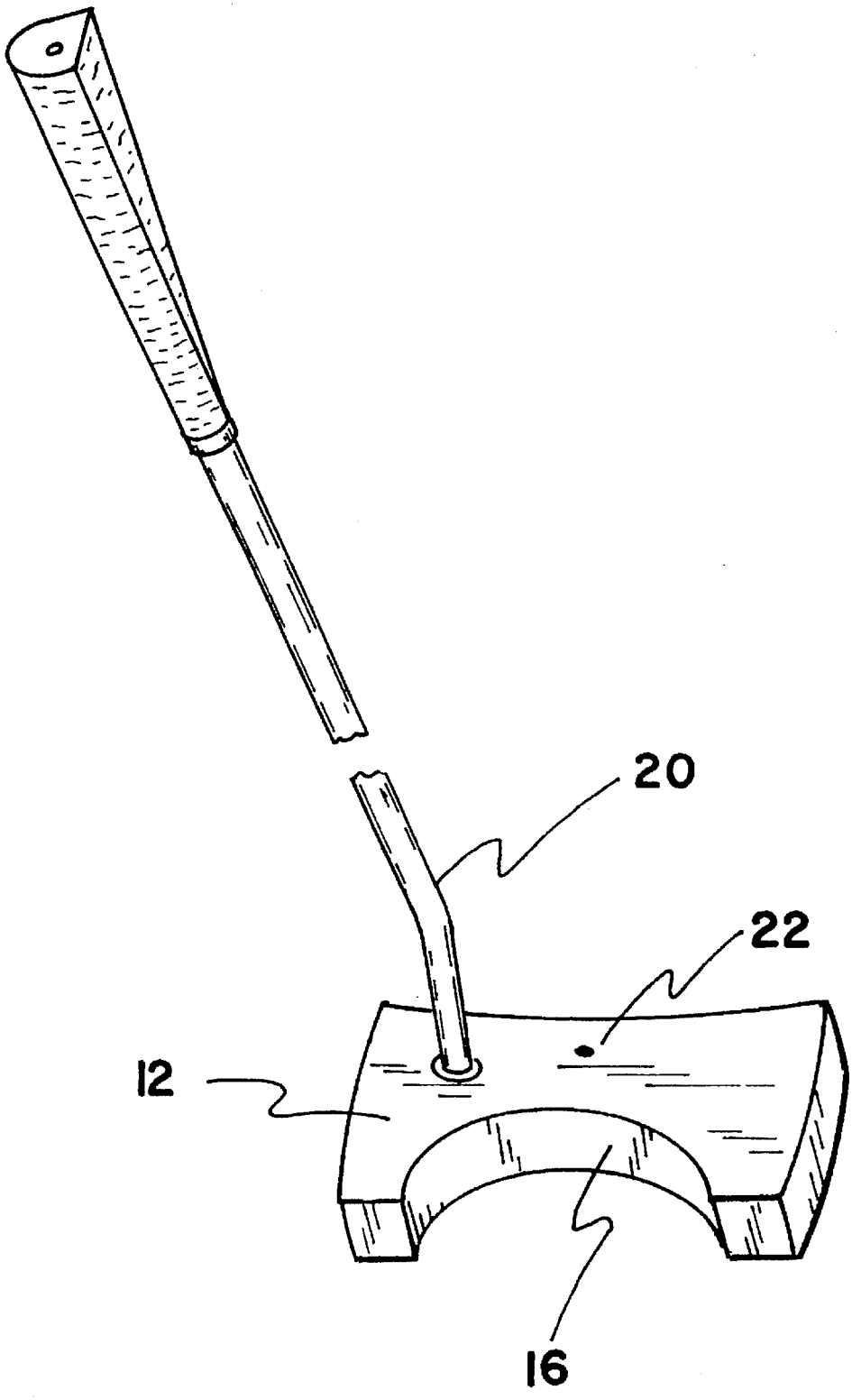
FIG. 5 is an isometric view of the putter.

FIG. 5 is an isometric view of putter 10. Sight 22 is used to indicate to the golfer the exact center of putter 10's "sweet spot".

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A golf club for hitting a golf ball along a predetermined path comprising:

a head having a toe portion, a heel portion, a face and a centerline dividing said toe portion from said heel portion, with the centerline substantially coincident with the intended path of the ball and with the centerline dividing said head into substantially equal heel and toe portions with each having substantially the same mass and shape; wherein the center of mass of said head is along the centerline away from the face of said head;

an upwardly extending shaft having a tip end, an upper end, a deflection curved portion adjacent to the tip end and a straight portion adjacent to the upper end, said tip end of said shaft connected to said heel portion of said head at a predetermined angle of approximately 7 degrees relative to the face of said head; wherein said deflection curve portion of said shaft is curved such that said straight portion of said shaft defines a first axis that intercepts on said front face of said head such that a second axis, perpendicular to said first axis at the intercept on said front face results in the second axis passing through the center of mass of said head thus resulting in said golf club to have centrifugal balance.

2. The golf club of claim 1 wherein said head is shaped for use as a putter.

3. The golf club of claim 2 wherein said head is manufactured from jadeite.

4. The golf club of claim 3 wherein said jadeite has a density of approximately 74 grams per cubic inch.

5. The golf club of claim 4 wherein said head weighs between 310 and 325 grams.

6. The golf club of claim 5 wherein said head further comprises a "sweet spot" substantially centered and substantially equally divided by the centerline on said face of said head.

7. The golf club of claim 6 wherein said "sweet spot" is approximately ⅞ inches wide on said front face of said head.

8. The golf club of claim 7 wherein said deflection curved portion is curved in accordance with the table in FIG. 4.

9. The golf club of claim 8 wherein said head further comprises a curved crown and sole having a radius greater than 8 inches.

10. The golf club of claim 9 wherein said head further comprises a uniform taper from said toe and heel portions, having an angle of approximately 3 degrees, which a user can utilize to visual align said golf club with said golf ball.

11. The golf club of claim 10 wherein said front face of said head has a 2 degree loft angle.

* * * * *